US009035243B2

(12) United States Patent
Lenkeit et al.

(10) Patent No.: US 9,035,243 B2
(45) Date of Patent: May 19, 2015

(54) METHOD AND A DEVICE FOR EARLY DETECTION OF FIRES

(75) Inventors: Kurt Lenkeit, Sulfeld (DE); Achim Schumann, Katlenburg (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 926 days.

(21) Appl. No.: 13/158,738

(22) Filed: Jun. 13, 2011

(65) Prior Publication Data

US 2011/0298623 A1 Dec. 8, 2011

Related U.S. Application Data

(63) Continuation of application No. PCT/EP2009/006445, filed on Sep. 11, 2009.

(30) Foreign Application Priority Data

Dec. 19, 2008 (WO) ..... PCT/EP2008/010916

(51) Int. Cl.
*G08B 17/10* (2006.01)
*G08B 17/117* (2006.01)
*G08B 17/11* (2006.01)

(52) U.S. Cl.
CPC ..... *G08B 17/117* (2013.01); *G08B 17/11* (2013.01)

(58) Field of Classification Search
CPC ..... G08B 17/10; H01J 49/40
USPC ..... 250/287
See application file for complete search history.

(56) References Cited

U.S. PATENT DOCUMENTS

| | | | | |
|---|---|---|---|---|
| 4,396,840 | A * | 8/1983 | Araki et al. | 250/381 |
| 6,900,432 | B1 | 5/2005 | Foulger et al. | |
| 7,227,136 | B2 * | 6/2007 | Walte et al. | 250/288 |
| 7,231,808 | B2 * | 6/2007 | Wagner | 73/31.02 |
| 7,279,680 | B2 * | 10/2007 | Miller et al. | 250/288 |
| 2008/0128609 | A1 | 6/2008 | Miller et al. | |

FOREIGN PATENT DOCUMENTS

| | | | |
|---|---|---|---|
| DE | 60005789 | T2 | 7/2004 |
| WO | 0045354 | A1 | 8/2000 |

OTHER PUBLICATIONS

G.A. Eiceman et al, "GC-PFAIMS as Smart Smoke Alarm. Identification of Combustion Sources by Patterns of Retention Time and Compensation Voltage"; vol. 5, No. 3, 2002 (p. 71-75); XP002544793.

* cited by examiner

*Primary Examiner* — Phillip A Johnston
(74) *Attorney, Agent, or Firm* — Harness, Dickey & Pierce, P.L.C.

(57) ABSTRACT

A method and device for early detection of fires is based on the detection of volatile thermolysis products which are characteristic of the material to be monitored, ambient air being aspirated from an area to be monitored with respect to fire and being ionized, the ionized gas flow being channeled through an electromagnetic field, the resulting field strength of which modifying the trajectories of the ions in their temporal and spatial dependence with a parameter set in such a manner that positive and/or negative ions of the ionized gas are forced onto pre-determined trajectories and are detected for generating a fire alarm. Accordingly, fires can be detected quickly and reliably in the earliest possible phase before their full development so that taking or initiating follow-up actions can occur particularly quickly and at an early stage.

20 Claims, 8 Drawing Sheets

METHOD AND A DEVICE FOR EARLY DETECTION OF FIRES

CROSS-REFERENCE TO RELATED APPLICATIONS

This application is a continuation of International Application No. PCT/EP2009/006445, filed Sep. 11, 2009 (now WO/2010/091703), which claims priority to PCT/EP2008/010916, filed Dec. 19, 2008. The entire disclosures of each of the above applications are incorporated herein by reference.

FIELD

The invention relates to a method for early detection of fires and a device for implementation of the method.

BACKGROUND

The present invention relates to a method for detection of volatile gases that are specific to the burning material, which are released before a fire in the phase of thermal decomposition. Monitoring these gases makes a pre-alarm and an alarm possible in order to take adequate preventive measures. The invention furthermore describes a novel fire detector which uses a detection of positive and negative ions of volatile gases by separating them after a passage through an electromagnetic field. Thus, it is possible to detect substance-specific thermolysis products in very low concentrations at a very early stage of the development of a fire.

The invention is adapted for use for fire detection, in diverse fields where smoldering fires (very slow temperature rise of the burning material) and thermal decomposition processes must be reckoned with. In the wood-processing industry, the food industry, IT, the field of telecommunication and stockpiling, for instance.

Conventional fire detectors are typically smoke detectors, heat detectors, or flame detectors. They rely on measuring physical values such as temperature, electromagnetic radiation, as well as light scattering by smoke aerosols. In addition to the detection of these classical fire parameters, gases can be detected in an early stage of the thermal decomposition. Smoldering fires which are not detected or detected too late in their formation phase often cause great damage. During the thermal decomposition process in a smoldering fire, gaseous products are released in different concentrations. CO, $H_2$, $CH_4$ and nitrogen oxides, for instance are among these. In the further development of the fire and with an increase of the temperature, the emission of products of a complete combustion such as $CO_2$ and $H_2O$ increases. These gases emitted during the formation phase of a fire can be detected at an early stage by using adequate gas sensor systems. Fire gas detectors using known sensors such as electrochemical cells, heat tone gas sensors, semiconductor gas sensors/sensor arrays and infrared absorption gas sensors are known. In addition to low-molecular fire gases such as CO, $H_2$, $CH_4$, $NO_X$, $CO_2$, and $H_2O$, which are formed with a sufficiently high energy supply, substance-specific high-molecular gases are also formed in the thermal decomposition process with a slightly lower energy supply and lower temperatures in the potential burning material, also referred to in short as material. In the following, these thermolysis products are referred to as substance-specific volatile thermolysis products characteristic of the material to be monitored. Examples include, for instance with wood: carboxylic acids, furan-derivatives, aldehydes, ketones and monoaromates. With polyurethane foams: toluene diisocyanate, and polyols.

A disadvantage of the mentioned conventional fire detectors and gas sensors is that they react only at an advanced decomposition stage of the burning material or after the outbreak of the fire. The fire parameters furthermore are not substance-specific. Fire alarms can furthermore be triggered by the influence of identical physical values in the environment. In the following, all measured values which serve for fire detection are referred to as fire parameters.

Keeping the intervention period, which extends from the formation of the fire and the triggering of a fire alarm signal to a fully-fledged firefighting, as short as possible depends particularly on an earliest possible detection of fire parameters.

A method for fire detection, which is supposedly adapted to recognize an increased risk of a fire outbreak based on measuring gases or vapors, is known from DE60005789T2 and WO/0045354. The method disclosed therein is supposed to be more specifically advantageous for the thermal heating and gas emissions of an electric component. This method is based on the known ion mobility spectrometry. It describes the detection of gases which are emitted during heating of electric components, such as printed circuit boards and resistors. The identities of these gases are not described. It merely describes how an ion mobility spectrum changes when gases are released from heated lacquer coated printed circuit boards and supplied to the spectrometer. A substantial disadvantage of this method is that it requires significant down time during saturation of the measured values by other gases which are released by a formation of a fire. This means that for a major time period surveillance with regard to the formation of a fire does not occur.

The main principle of ion mobility spectrometry is based on the fact that ions formed under normal pressure, drift against the flow direction of a gas in an electrical field. Ions of different mass and/or structure achieve different drift velocities and are separated until they impinge a detector chronologically one after another. The ratio between the ion drift velocity and the force of the electric field is referred to as ion mobility and the separation of these ions along a determined distance based on the different drifting velocities is referred to as ion mobility spectrometry. The low field strengths and the resulting independence of the ion mobility from the field are characteristics of this method.

An ion mobility spectrometer consists substantially of a drift tube which in turn consists of a reaction chamber and a drift chamber. Both chambers are separated from each other by an electric switching grid.

A disadvantage of this method is that electric switching grids are required for admission of samples and that shielding grids are required in front of the detector. Thus, the detector has greater dimensions and is often more expensive. It can furthermore be disadvantageous that either only positive or only negative ions are measured, while a detection of both positive and negative ions as fire formation parameters is not possible.

US Patent Publication No. 2008/0128609A1 describes a method and device which is a further development of an ion mobility spectrometer. It concerns a system for differential ion mobility spectrometry (DMS). Such DMS systems use the field dependence of the ion mobility in order to obtain a higher selectivity in substance identification. Samples to be analyzed are extensively prepared, ionized and the ions are channeled by a high-frequency alternating electric field by means of a compensation voltage to measurement electrodes. Magnetic fields for influencing the ion trajectories are not used.

The example 10 of US Patent Publication No. 2008/0128609A1 and the publication "GC-PFAIMS as Smart Smoke Alarm, G. A. Eiceman et al, Vol. 5, No. 3, 2002, pages 71-75, XP-002544793" describes the chemical analysis of volatile decomposition products of cotton, paper, grass and motor exhaust gases by means of the DMS method and device, which pre-connects a gas chromatograph (GC) to the DMS System for pre-separation. The method and the analysis are divided into five substantial steps. First, the ignition of the sample, secondly, the enrichment of the forming decomposition gases on a SPME-fiber (Solid Phase Micro-Extraction), thirdly, the thermal desorption of the enriched gases of this fiber, fourthly, the chromatographic separation of the gases and fifthly, the substance identification with the downstream DMS System. In addition, nitrogen is hereby used as a carrier gas for transporting the substances to be analyzed through the electric field. This is another additional undesirable technical expense.

The presented solution does not constitute a fire detection system but merely shows the potential possibilities allowing substance identification and a differentiation of smoke gases from different sources with the described GC/DMS-based highly complex chemical analysis.

Disadvantages of this solution include highly complex equipment (and thus high costs) caused by pre-separating the substances with a GC, the sample preparation as well as a long duration of the analysis. Another disadvantage of the spectrometric GC/DMS method for fire detection is the need to compare the measured values with known identification data in order to allow a classification and substance identification. With regard to fire detection, this means that all of the substances that are to be identified must be previously known and that this identification data must be stored in the memory of the spectrometer.

A fire gas or smoke detector is known from the document DE100357371A1 which uses an ion current, which is related to the appearance of fire gases or fire smoke, and which can be measured in case of a high voltage between a corona-discharge electrode (cathode) and a suction electrode (anode). The disadvantage of this method is that all of the supplied substances contained in the air and not only the products of a thermal decomposition from a forming fire, which are ionized by the corona discharge, contribute to the fire alarm. One must thus expect a high rate of false alarms (falsely positive detection).

SUMMARY

Based on the mentioned prior art, the object of the invention is to develop a method and a device which overcomes the disadvantages of the prior art, so that fires can be reliably and rapidly detected in a very early formation stage with minor technical expense and small apparatuses, and a fire alarm can be triggered.

False alarms which can be caused by non-fire signals must furthermore not lead to activating a fire alarm.

The proposed solution describes a method for early detection of fires based on the detection of volatile thermolysis products which are characteristic of the material to be monitored. Air is thereby aspirated from the area to be monitored and ionized, a filtering and heating of the gases being possible during aspiration. The aspiration of the ambient air can occur for instance via a pipe system with aspirating holes, via flexible tubes or via a plurality of flexible tubes or pipes with aspirating holes. Ambient air can thus be aspirated from different areas via a measuring point switch. Aspiration as a bypass from a force-guided air flow from a room, a hall or in an object such as a machine or an IT-rack is also a solution. The aspiration can also be implemented inside a punctual fire detector or as a bypass in an aspirating smoke detection system. The solution is however not restricted to these examples but should rather refer to all analog examples known to one skilled in the art.

The device and the method are described in the following by means of an exemplary embodiment and eight figures. In the drawings:

DRAWINGS

Figure 7:
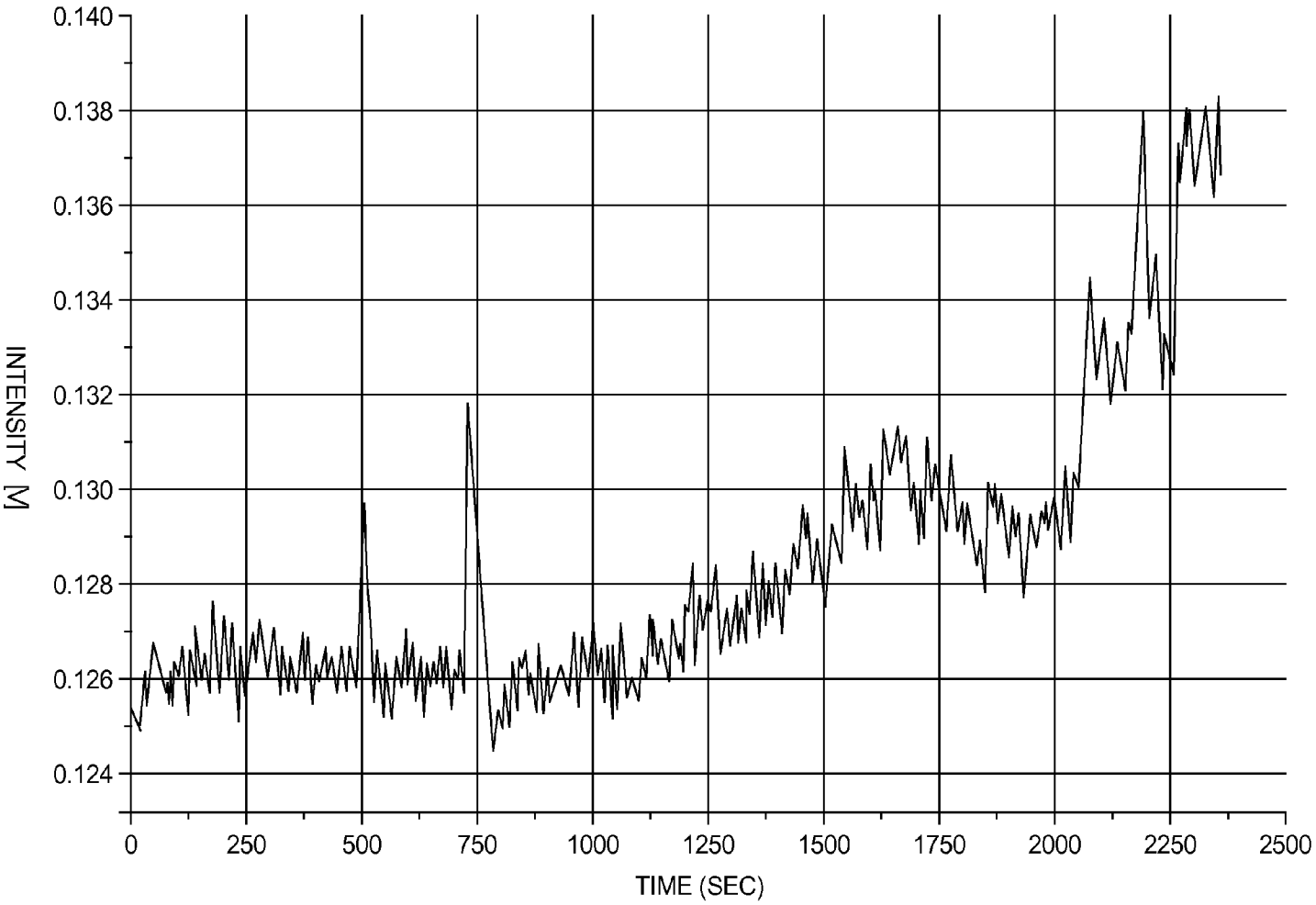
Figure 8:
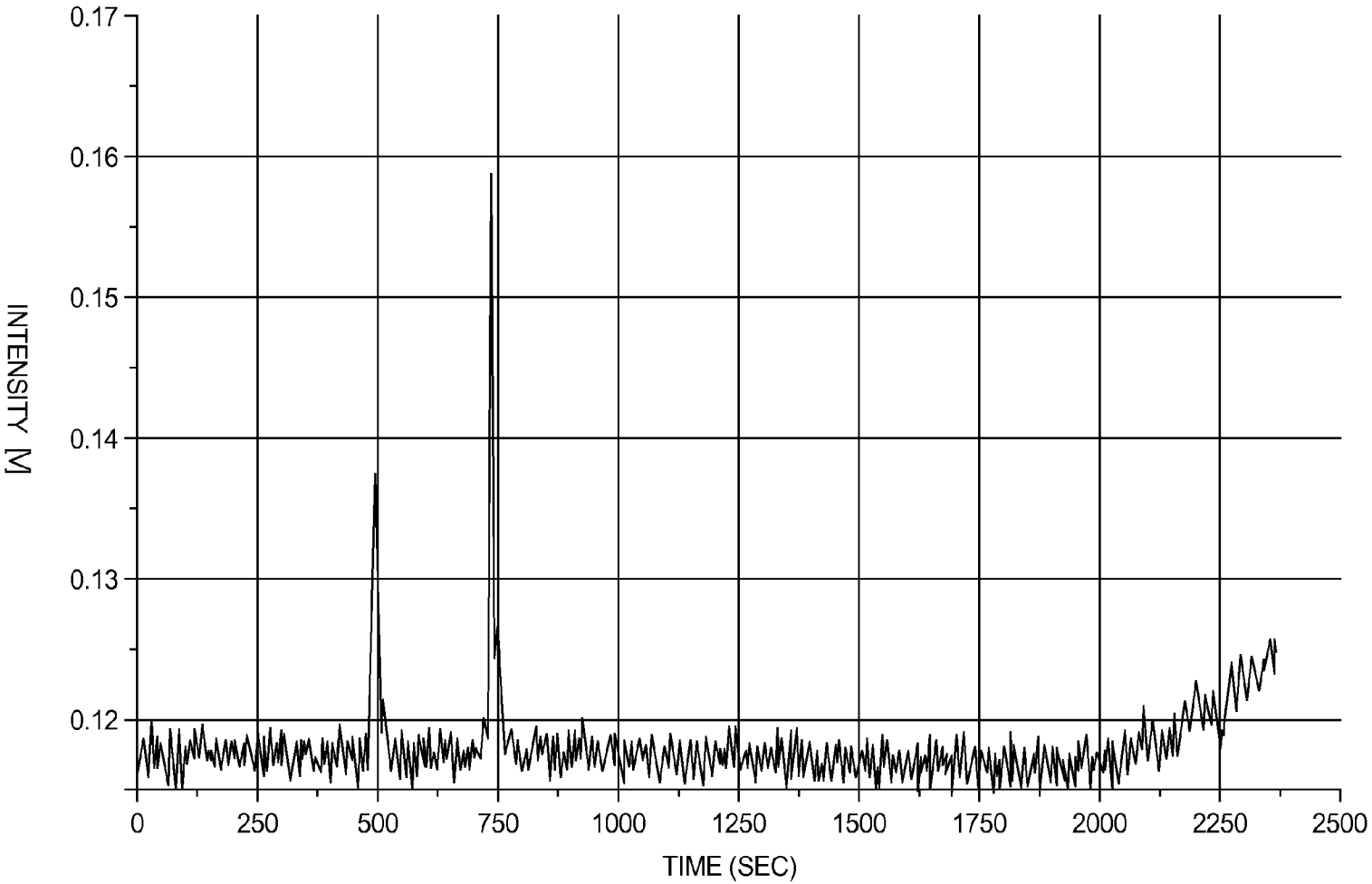

FIG. 7 shows the time dependence of the negative ion current intensity at a D.C. voltage of −9.47 V during the thermolysis of beech wood and the influence of cigarette smoke at approximately 420 and 740 s; and FIG. 8 shows the time dependence of the negative ion current intensity of cigarette smoke at a D.C. voltage of 0.21 V during the thermolysis of beech wood and the influence of cigarette smoke at approximately 420 and 740 s.

DETAILED DESCRIPTION

Figure 1:
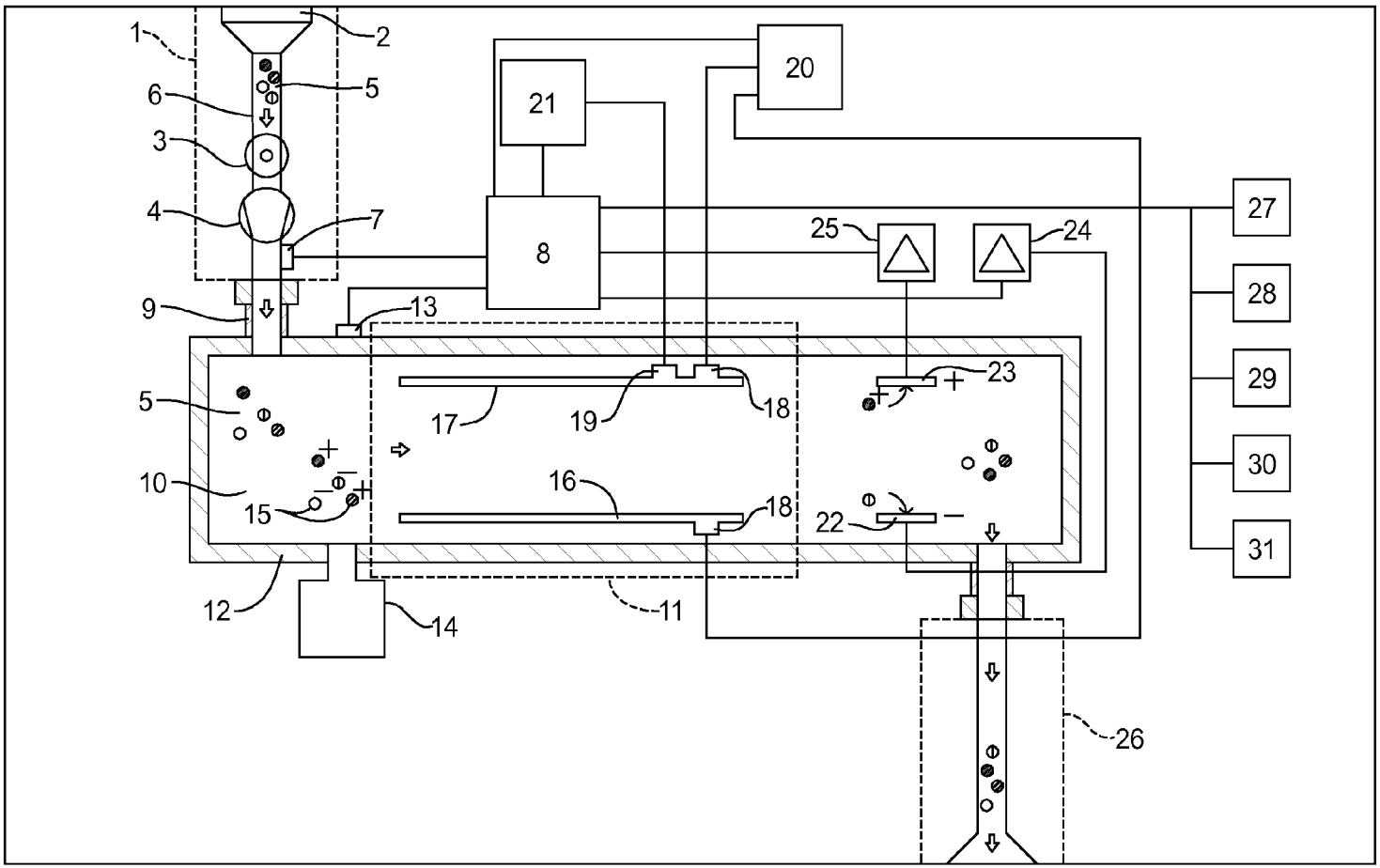
FIG. 1 shows a schematic representation of a device for early detection of fires based on the detection of characteristic volatile thermolysis products.

FIG. 1 shows a schematic representation of the device for early detection of fires based on the detection of characteristic volatile thermolysis products which are specific to burning material to be monitored. The device consists of all the parts which are located inside the shown frame. In the present embodiment, it consists of the replaceable aspiration unit 1 with a filtering unit 2, the filter element of which has a pore size of 1 to 80 μm and allows a separation of the humidity due to the hydrophobic filter material, furthermore of the valve 3 which is a needle valve, the pump 4 which is configured as a membrane pump, the sample gas tube 6 which is heatable and on which a flow sensor 7 is disposed which is connected to the micro-controller system/signal processing unit 8. The gas flow 5 from the ambient air of the hazard area to be monitored for which an early detection of a fire is relevant is aspirated into the sample gas tube 6. The aspiration unit 1 is fitted (e.g. screwed) to the inlet socket 9 which is located on the casing of the ion generation and ion current measuring chamber 10. The gas flow 5 which reaches the ion generation and ion current measuring chamber 10 is ionized by the ionization device 14 and is channeled through the electrodes 16, 17 for generating an alternating field and an overlapping D.C. voltage field, positive and negative ions being forced onto a predetermined trajectory in the electric field. They reach the area between the electrometer plates 22, 23 by which positive and negative ions are detected. In the present case, amplifiers 24, 25 which amplify the measuring signals and which are connected with the micro-controller system/signal processing unit 8 for measurement control, data storage, data analysis and regulation, are connected to the electrometer plates 22, 23. The electrodes 16, 17 are equipped with connectors 18, 19 for generating and regulating the alternating field 20 and for generating and regulating the D.C. voltage 21. The generation and regulation of the D.C. voltage 21 as well as the generation and regulation of the alternating field 20 are connected to the micro-controller system/signal processing unit 8. In the present case, signals and data are transmitted by the micro-controller system/signal processing unit 8 to the display unit 27, to the operating panel (key- and annunciator panel) 28, to the interface of the fire alarm panel, central fire alarm and/or hazard alarm system or to the building master control system 29. The device can be parameterized and a read-out of measuring data and software updates can occur via the interface 30 by means of a PC or a service device for instance. The interface or a replaceable communication module 31 allows integration into a loop of addressable fire detectors for transmitting status, malfunction and alarm messages via a protocol to a fire alarm panel or central fire alarm system for instance. The display unit 27 allows a display of malfunctions and different alarm levels and a display of a low alarm level with which the attention to the fire source to be monitored can be increased and an alarm or extinguishing process can be triggered when the highest alarm level is reached. The gas flow 5 leaves the casing 12 of the ion generation and ion current measuring chamber via the gas outlet unit 26 which is replaceable.

Figure 2:
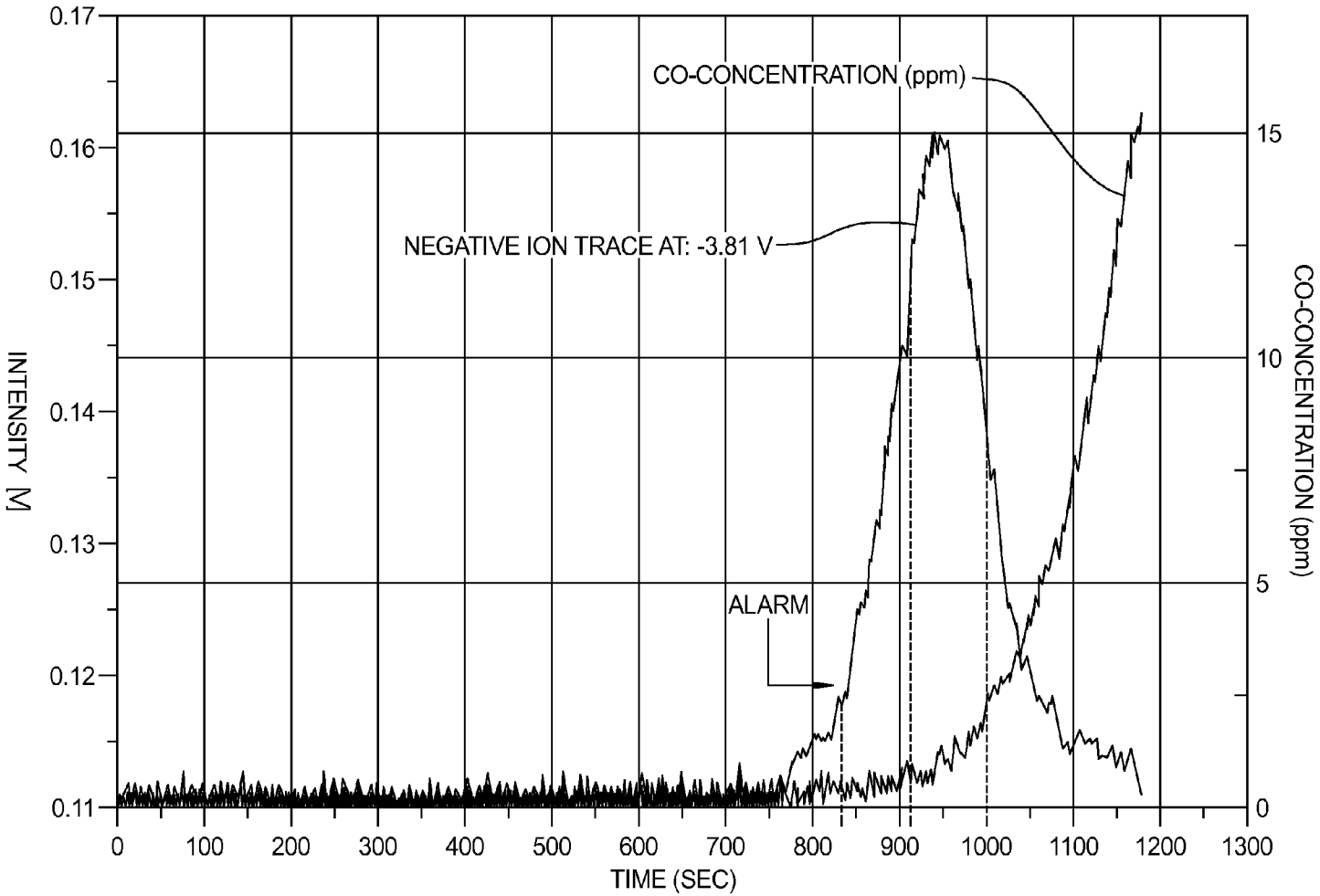
FIG. 2 shows the time dependence of the negative ion current intensity at a D.C. voltage of −3.81 V and of the CO concentration during the thermolysis of beech wood with a possible alarm level.

FIG. 2 shows the time dependence of the negative ion current intensity at a D.C. voltage of −3.81 V and an AC voltage of 1500 V as compared to an electrochemical carbon monoxide sensor typically used in commerce. The curve rises after 780 seconds (corresponds to a sample temperature of 155° C.) and reaches a maximum after 950 seconds. The measuring curve of the carbon monoxide sensor rises only after reaching 950 seconds. This behavior makes it clear that the processing of the signal of the new fire detector has significant temporal advantage as compared to the CO-detector typically used in commerce.

Figure 3:
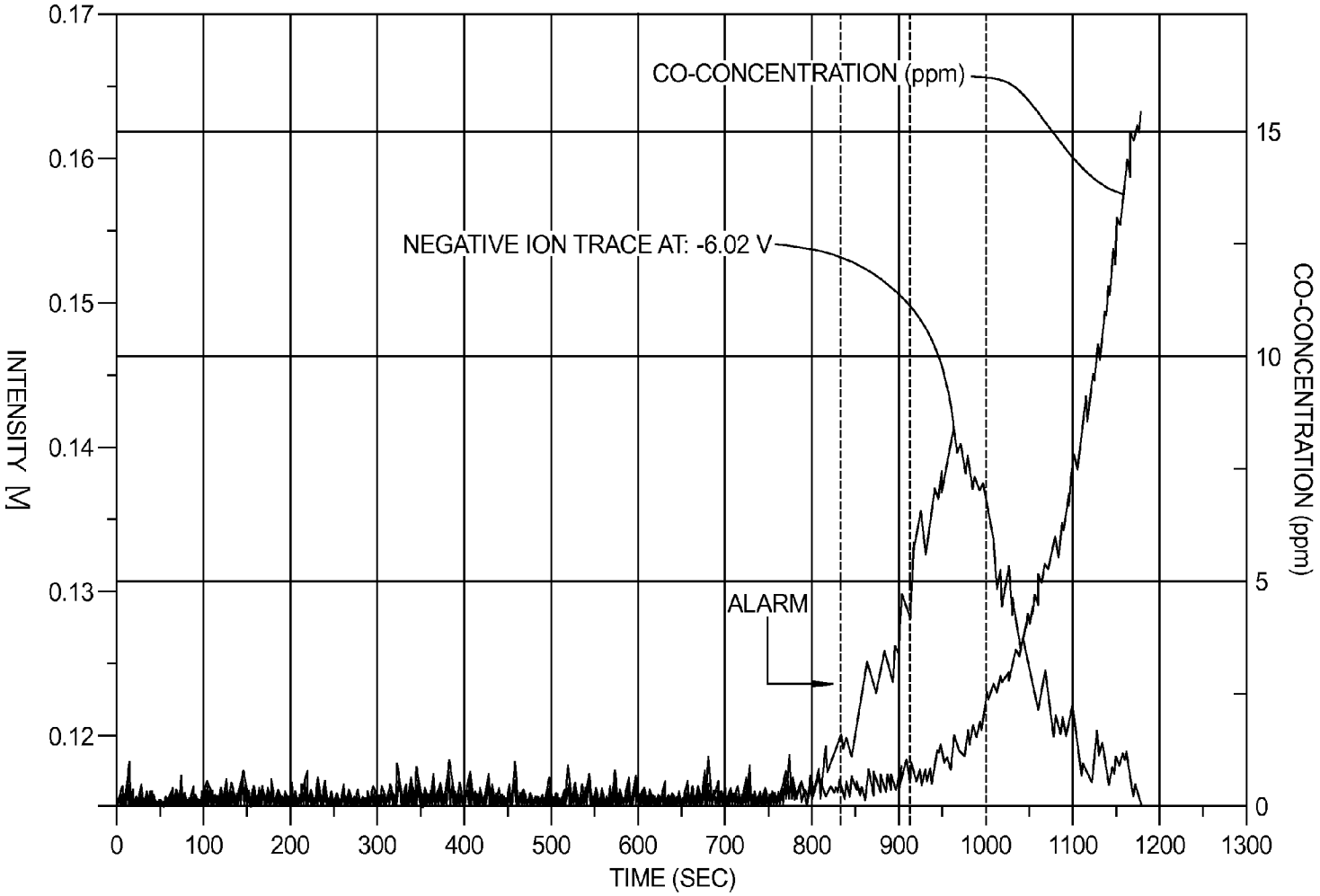
FIG. 3 shows the time dependence of the negative ion current intensity at a D.C. voltage of −6.02 V and of the CO concentration during the thermolysis of beech wood with a second possible alarm level.
Figure 4:
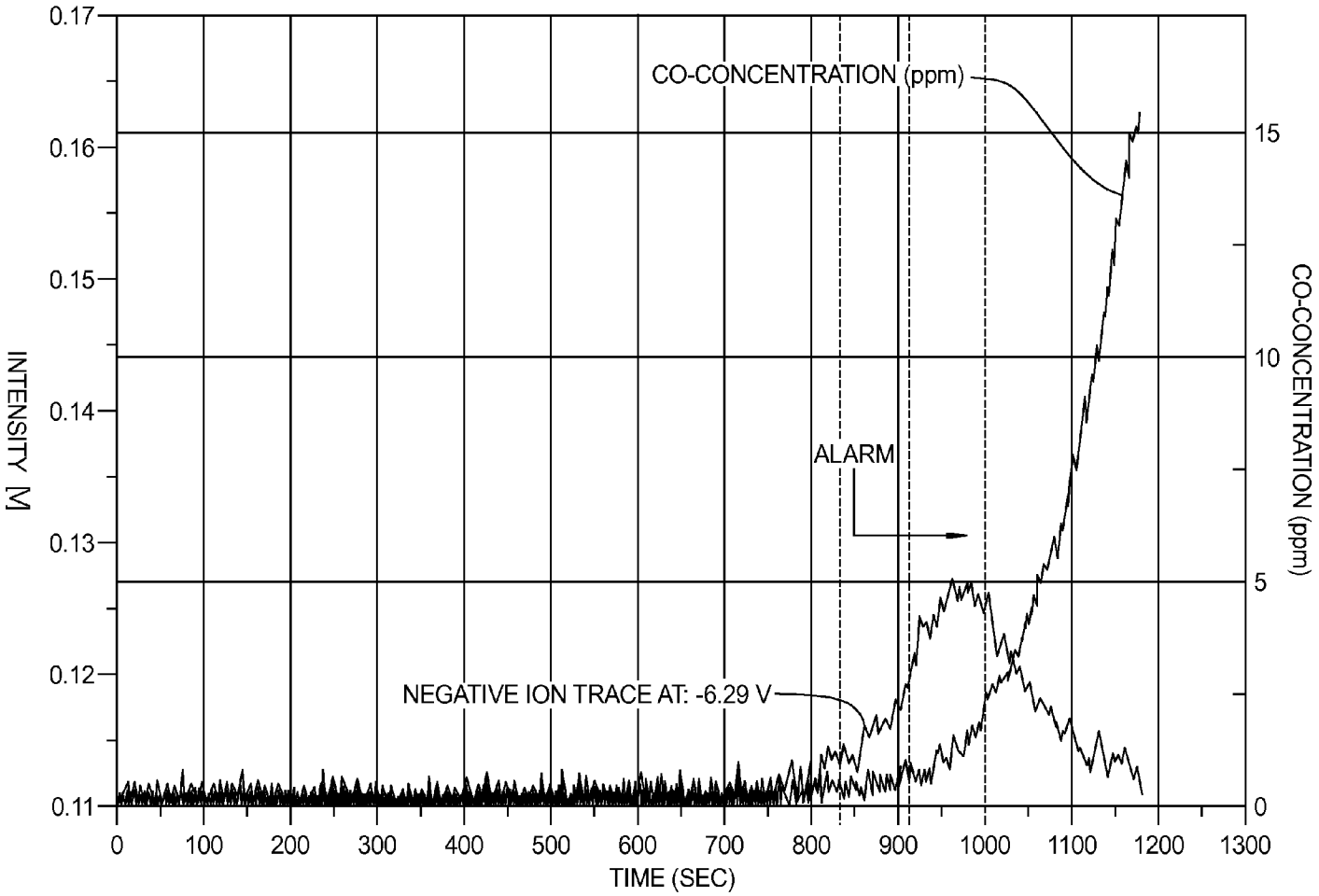
FIG. 4 shows the time dependence of the negative ion current intensity at a D.C. voltage of −6.29 V and of the CO concentration during the thermolysis of beech wood with a third possible alarm level.
Figure 5:
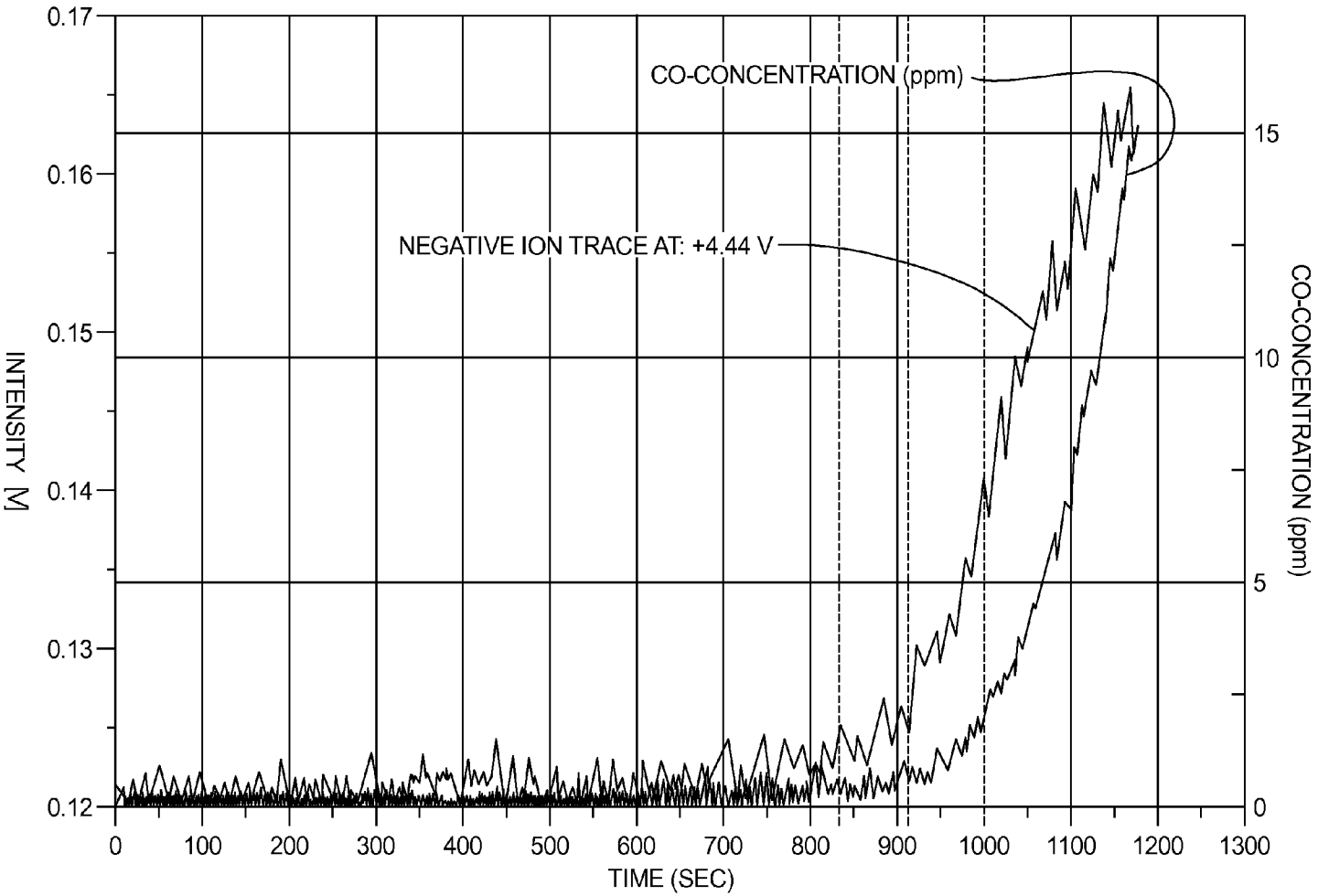
FIG. 5 shows the time dependence of the positive ion current intensity at a D.C. voltage of +4.44 V and of the CO concentration during the thermolysis of beech wood.

In a particular preferred embodiment for triggering a fire alarm, three other ion currents (FIGS. 3, 4 and 5) of different polarities and different inverse voltages (−6.02; −6.29 and +4.4V) are used which ensure as a whole the general alarm criterion and minimize the possibility of a false positive alarm. Three alarm levels have been determined for each respective sequence.

All four curves show that a detection of fires with the proposed method is possible at a much earlier stage than with customary methods and that different alarm levels can be triggered at a very early point in time. At this point in time measurable smoke aerosols are not present and flames cannot be detected.

One or more alarm levels can also be triggered by a significant increase of the ion current relative to only one parameter of the field generation, for instance a D.C. voltage value, with pre-determined thresholds.

Figure 6:
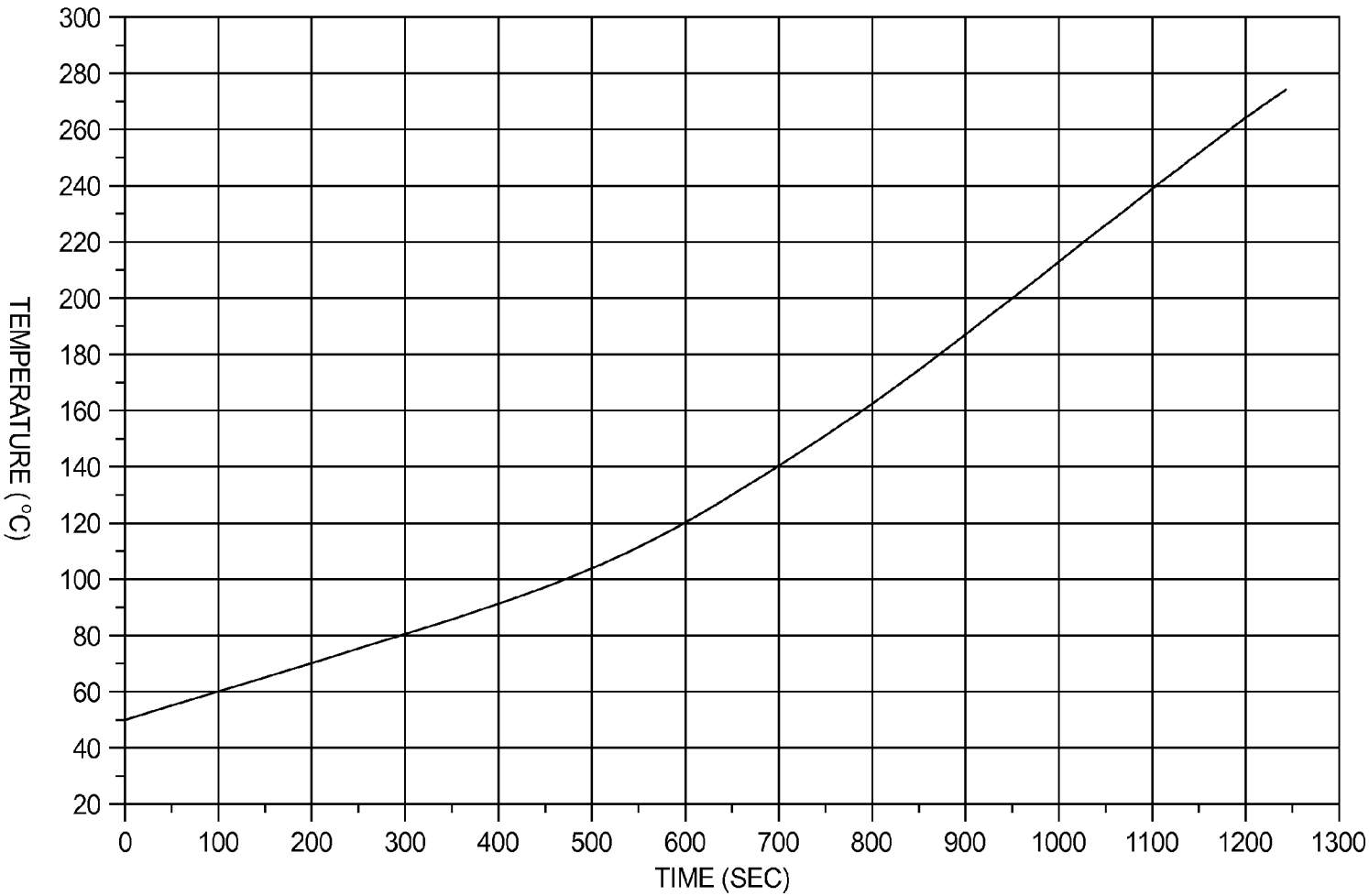
FIG. 6 shows the time dependence of the temperature of beech wood relative to the curves of FIGS. 2, 3, 4 and 5.

FIG. 6 shows the time dependence of the temperature of beech wood relative to the curves of FIGS. 2, 3, 4 and 5. From this it follows that the first alarm level is triggered at approximately 170° C., a second alarm level is triggered at approximately 190° C. and a third alarm level is triggered at approximately 210° C.

FIG. 7 shows the chronological sequence of the characteristic negative ion trace (electric signal of the negative ions) for wood at a D.C. voltage of −9.47V (AC voltage of 1500V) during the thermolysis of beech wood and the influence of cigarette smoke at approximately 420 s and 740 s. The meaning of the significant measuring signal change at approximately 420 s and 740 s is apparent in FIG. 8. The significant increase of the ion current from approximately 1300 s is caused by the release of wood-specific thermolysis products.

FIG. 8 shows the time dependence of the negative ion current intensity at a D.C. voltage of 0.21 V (AC voltage of 1500V) during the thermolysis of beech wood and the influence of cigarette smoke at approximately 420 and 740 s. Other cigarette smoke specific signal increases for positive ions are measurable for two different D.C. voltage values.

The sets of parameters of disturbance values, i.e. the sets of parameters of the field, which allow a measuring of the ion currents of this disturbance value, can be stored in the memory of the micro-controller system/signal processing unit 8. This can be applied to all relevant disturbance values.

The possibility is thus provided to previously record typical potential disturbance values without spectrometric substance identification by means of the device, i.e. to store the data of parameter sets for field generation, with which ion currents of disturbance substances are measured, in the micro-controller system/signal processing unit 8. During use of the device for early detection of fires based on the detection of characteristic volatile thermolysis products, the disturbance values are then masked (discriminated) out in the micro-controller system/signal processing unit 8 by means of processing and evaluation algorithms in order to trigger the fire alarm signal.

The substance-specific detection of thermolysis products with different field strengths, i.e. different D.C. voltage values makes it possible to eliminate disturbance values such as cigarette smoke for instance.

If a significant change of the ion current is detected, with a parameter set for field generation which has been stored as a parameter set of a disturbance value, this significant change is masked out as a disturbance value and does not lead to a fire alarm.

If a significant change of the ion current is detected with at least one parameter set for field generation for which no disturbance value has been stored and the processing and/or evaluation algorithms suggest a formation of a fire, a fire alarm is triggered.

The ionized gas flow which, in a hazardous situation, contains substance-specific gases during thermal decomposition is channeled through an electromagnetic field. This field is designed in such a manner that the resulting field strength in its time and spatial dependence modifies the trajectories of the ions in such a manner that positive and/or negative ions of thermolysis gases are forced into determined trajectories by means of at least one constant, pre-selected set of parameters for generating the field and are measured by a detector.

An electromagnetic field hereby is a superposition of a magnetic and electric field, the variants in which the magnetic field strength or the electric field strength equals zero also being possible. The fields have a force action on the charged particles such as the previously mentioned ions. The Lorentz force $F_L$ is the sum of the force action of the electric field $F_E$ and of the magnetic field $F_B$, $F_L=F_E+F_B$. If there is no magnetic field, $F_B=0$. The trajectories of the ions are then only influenced by the electric field. If there is no electric field, $F_E=0$. In this case, the trajectories of the ions are only influenced by the magnetic field. However, it can also be advantageous to use the effect of both fields.

The modification of the field generation parameters can be carried out gradually or continuously. Negative and positive ions are detected simultaneously or can be time-delayed.

While the residual ions that have not been detected escape with the gas flow, a measuring signal, which can be stored, is generated by the ions measured by the detector. For instance, the detector can measure the current generated by the detected ions.

The measuring signal can also be a processed signal and the combination of measuring signals of positive and negative ions.

In the following, the stored measured values and their potential processing are also referred to as measuring signals.

The escaping gas flow can also not include ions because of recombination processes or devices for neutralizing the ions.

The pre-selected set of parameters depends on the type of the field. In a defined geometry and arrangement of the electrodes and/or the electromagnetic coils for generating the field and the frequency of the field, these parameters are e.g. voltage and current values.

The pre-selected set of parameters can be pre-determined for substances and groups of substances. This set of parameters can be entered for instance manually and/or be available as a stored data set for parameterization of the method. This is expedient when the burning material consists only of a previously known substance, or group of substances or only one substance group.

In a particular preferred embodiment, the time dependence of the measuring signals for different field settings is measured and stored. If a mix of different substances are generally present, which are thermally decomposed during the formation of the fire, the time dependence of the measuring signals for different field settings is measured and stored.

The stored measuring signals and/or signal patterns are analyzed by processing and evaluation algorithms for the presence of significant changes, e.g. maxima and/or changes of the rate of rise or by comparing them with stored signal patterns/values. If significant changes are found, this leads to a fire alarm signal in a very early stage of the formation of the fire.

A fire alarm signal is to be understood as any signalization of a hazard situation which arises from a temperature increase of a potential burning material or substance mixture. The signalization can occur for instance acoustically or optically or by a transmission for instance to a central fire alarm system, to a fire alarm panel, a building master control system, a central hazard alarm system or a control center with a further signal processing and pre-defined follow-up actions.

An advantageous embodiment of a determination of significant changes of the measuring signals leading to a fire alarm signal, also resides in observing an increase of the measuring signals over a period of time, exceeding a pre-defined value, exceeding a maximum value and/or of a pre-defined change of the rate of rise. This can be advantageous for detecting positive and/or negative ions with only one or few sets of parameters for generating a field. Thus, substance identification is not mandatory for triggering a fire alarm signal.

Another advantageous embodiment of the method consists in the availability of at least one signal from another sensor system for detecting another fire parameter and using it for triggering a fire alarm signal.

In order to minimize the risk of a false alarm, the non fire signals are sorted out (discriminated) by the possibility of a substance-specific differentiation of the measuring signals. This means that disturbance values are identified by processing and evaluation algorithms and do not lead to a triggering of a fire alarm signal. Disturbance values are determined substance-specific signals, which do not correspond to a thermal decomposition of the burning material to be monitored, such as cigarette smoke for instance.

It is advantageous if the sets of parameters of disturbance values, such as cigarette smoke for instance, i.e. the sets of parameters of the field which allows the measurement of the ion currents of these disturbance values, are stored in the memory of the micro-controller system or the signal processing unit. This can be applied to all relevant disturbance values.

Typical, potential disturbance values are hereby previously recorded, i.e. the data of the sets of parameters for generating a field with which ion currents related to disturbance substances are measured and stored in the micro-controller system or in the signal processing unit. During use of the device for early detection of fires based on the detection of characteristic volatile thermolysis products, the disturbance values are then masked out (discriminated) for the triggering of a fire alarm signal through processing and evaluation algorithms in the micro-controller system or in the signal processing unit.

It can thereby be advantageous to consider a detected significant change of the ion current relative to a set of parameters for field generation that has been stored as a set of parameters of a disturbance value, as a disturbance value.

In a particular preferred embodiment of triggering a fire alarm or a pre-alarm the processing and evaluation algorithms suggest a fire formation if a significant change of the ion current for a set of parameters for field generation for which no disturbance value has been stored is detected.

The ionized gas flow is preferably channeled through an electric field with a high field strength which is overlaid (superimposed) with a field generated by a D.C. voltage. The electric field should preferably be an asymmetric alternating field. It is thereby advantageous if it has a voltage of 300 to 2,000 Volts, preferably 500 to 1,500 Volts.

It is furthermore advantageous if the field strength amounts to between 5,000 and 50,000 V/cm, preferably between 10,000 and 30,000 V/cm.

The applied alternating field can have a frequency between 0.1 and 10 MHz, preferably 1 MHz.

The D.C. voltage can lie between −100 and +100 Volts, preferably −43 and +15 Volts.

In the electric field, positive and/or negative ions are forced by at least one D.C. voltage value onto a pre-defined trajectory and are detected by a sensor. In this case, the time dependence of the measuring signal, for instance of the ion current (electric signal after the detection of ions) is measured. As a rule, ions of a substance-specific thermolysis gas are measured in this manner or positive and negative ions of different gases if positive ions of a gas and negative ions of another gas are incidentally forced onto the trajectories for detection by a sensor.

It is alternately possible to gradually modify the D.C. voltage in a pre-defined interval, so that positive and/or negative ions are forced onto defined trajectories and detected. The steps in which the D.C. voltage is increased can be equal or have different values. It is advantageous for instance to carry out the increase in steps of 0.3 Volts in the entire range. In this manner, a set of curves representing the time-dependence of the currents of positive and/or negative ions for each defined D.C. voltage value is measured and stored. Substance-specific ions or sum signals resulting from the superposition of several ion types of different gases (substance-specific thermolysis products) can thus be measured for early fire detection.

The stored measuring signals or signal patterns are preferably continuously tested by means of processing and evaluation algorithms in a signal processing unit for the presence of significant changes, such as for instance maxima and/or changes of the rate of rise. Another advantageous signal processing is based on a comparison with stored signal patterns/values. If significant changes are found, this leads to triggering a fire alarm signal at a very early stage.

The duration of the detection and analysis preferably amounts to 2 to 3 seconds. This is a considerably shorter time than that required by other methods for identifying substance-specific thermolysis gases.

Another advantageous embodiment of the method consists in that the triggering of a fire alarm signal is based on the number and position of the maxima and/or exceeding of pre-defined values of the measuring signals, for instance of the ion currents and/or their change of the rate of rise.

The identification of the substance-specific maxima of the ion currents with defined method parameters is preferably carried out by a comparison with stored signal patterns.

Another advantageous embodiment of the method consists in that a signal of another sensor system for detecting low-molecular gases such as CO and/or smoke aerosols, for instance, is used for triggering the fire alarm signal.

The measuring signal detection, storage and data analysis (processing and evaluation algorithms) is preferably implemented under software control through corresponding electronic circuits with micro-controller systems and memories. The use of application specific integrated circuits (ASICs) can also be advantageous.

The method makes it possible to activate a multiple-stage fire alarm. This can occur for instance in such a manner that, with a first significant increase of the ion current for one of the D.C. voltage values, a first signal (e.g. pre-alarm 1 or $1^{st}$ alarm level) is displayed and given to a surveillance device (e.g. central hazard alarm system, central fire alarm system/panel, control centre) or a person. With a second significant increase for another D.C. voltage value, a second alarm level is issued. With a third significant increase of the ion current for another D.C. voltage value ($3^{rd}$ alarm level) an alarm can be triggered, for instance in central fire alarm system or fire alarm panel. Different alarm scenarios depending on the type of fire and extent of the danger or the configuration of the facility can be adjusted for this.

The use of one of the alarm signals or of the fire alarm signal for activating other protection devices, such as oxygen reduction systems or shutdown of machines also constitutes an advantageous use of the fire alarm signals.

One or more alarm levels can also be generated by a significant increase of the ion current measured for only one parameter of the field generation, for instance a D.C. voltage value, with pre-defined thresholds.

The proposed method makes it possible to detect substance-specific thermolysis products in extremely low concentrations at a very early stage of the fire formation and to activate alarms with different alarm levels. With wood for instance, a fire signalization is possible with smoldering fire and a slow temperature increase of the burning material below 220° C.

As opposed to ion mobility spectrometry, electric switching grids are not required, which makes it possible to draw on practically all generated ions for detecting the gas. The detection limits are thus lowered many times.

The method for early detection of fires and for a gradual alarm is based on the field dependence of ion mobility which occurs at high field strengths.

The device for early detection of fires by detecting characteristic volatile thermolysis products, which are specific to the burning materials to be monitored, consists of an aspiration unit and an ionization device in which the aspirated gas flow is ionized. The aspiration unit can be replaceable, for instance after contamination. A rigid or flexible pipe system with aspiration apertures can be connected to the aspiration unit in order to aspirate the ambient air from different areas or apparatuses. The aspiration unit consists as a rule of a filtering unit, a valve, a pump and a sample gas tube through which the gas flow is pumped. A flow sensor can be connected to the sample gas tube. The filter unit can consist of hydrophobic Teflon, another hydrophobic material or of a membrane, for instance made of a dimethyl-silicone, for gas permeation. The membrane can be individually replaceable. The membrane can furthermore be disposed directly before the ion generation chamber or also in an inlet socket so that it is replaceable.

The inlet socket is thereby configured in such a manner that another gas supply is possible parallel to the sample gas inlet. This other gas supply can be used for cleaning and/or dilution purposes by means of cleaned dry air or nitrogen without interrupting the actual measuring process. This gas supply should furthermore allow a parallel operational test of the detector with different gas standards.

The valve should be preferably configured as a needle valve. A mass flow controller or a simple flow reduction by means of a pinhole is also conceivable. A membrane pump can be used as a pump. A rotary vane piston pump, a linear compressor or, at low pressures, a blower/fan are also conceivable.

The sample gas tube can be heatable and replaceable and should be equipped with a chemically inert, thermally stable and anti or non-adhesive surface. Gases from the ambient air which quickly and reliably reflect the changes of the burning material are collected by means of the aspiration unit and are led into the casing of the ion generator or of the ion current measuring chamber via an inlet socket.

In a particular preferred embodiment the aspirated gas flow can reach an ion generating and ion current measuring chamber via an inlet socket. This chamber can be disposed in a heatable, temperature-controlled casing in or on which a temperature sensor is located. An ionizing device, which generates ions from the aspirated gas, is furthermore disposed on the generating and ion current measuring chamber. The ionization device can be a radioactive emitter, for instance from $^{63}$Ni, or a UV-source. Electrodes for generating an alternating field are disposed after the ionization device. They can have a chemically inert, thermally stable and anti- or non adhesive surface. Connectors for generating and regulating an alternating field and connectors for generating and regulating a D.C. voltage, which are connected to the generation and regulation of the D.C. voltage or to the generation and regulation of the alternating field, are connected to the electrodes. Electrometer electrodes for positive and negative ions configured as electrometer plates are disposed after the electrodes for generating an alternating field and are connected to a micro-controller system and memory for measurement control, data storage, data analysis and regulation. It is advantageous to dispose signal amplifiers between the micro-controller system and the electrometer electrodes. The casing of the ion generation and ion current measuring chamber furthermore has a gas outlet unit which can be replaceable and can be equipped with a chemically inert, thermally stable and anti or non adhesive surface. The aspirated gas flow and thus the ions moving through the measuring chamber can also be alternately implemented via a pump, a blower/fan or a compressor in the gas outlet unit or arranged before it. The micro-controller system can display malfunction of the device, operating states and alarms. The display can occur via LEDs. A display via text messages on an alphanumeric display capable of displaying graphics. The micro-controller system can be connected to an operating panel, various interfaces, for instance with the fire alarm panel, central fire and hazard alarm system, to the building systems and also to the flow sensor and temperature sensor on the casing of the ion generation and ion current measuring chamber, to the electrometer plates as well as the circuit for generating and regulating the alternating field and the D.C. voltage for the overlaying field. A control panel (key- and annunciator panel) allows setting a defined operating state, to display stored data and to set parameters for detection. A parameterization, readout of measuring data and update of the software can occur via an interface. An integration into a loop of addressable fire detectors for transmitting status, malfunction and alarm messages via a protocol to the fire alarm panel or e.g. central fire alarm system can furthermore occur via an interface or a replaceable communication module.

An advantage of this method and of this device for early detection of fires is that fires are quickly and reliably detectable in the earliest possible phase before their full development by means of small apparatuses and without great expense and can be ranked into different alarm levels, so that taking or initiating follow-up actions can occur particularly quickly and at an early stage. With the detection of substance-specific thermolysis products it is furthermore advantageous that disturbance values can be recognized and do not influence the fire alarm.

What is claimed is:

1. A method for early detection of fires based on the detection of volatile thermolysis products which are characteristic of the material to be monitored, which are channeled in an ionized state through an electric or magnetic or electro-magnetic field, the resulting time and spatial dependent field strength of which modifies the trajectories of the ions for at least one parameter set in such a manner that positive and/or negative ions of the ionized gas are forced onto pre-determined trajectories and are detected and measuring signals are generated by the detected ions and are stored, comprises the following steps:

continuous aspiration of the volatile thermolysis products with the ambient air from an area which is monitored with respect to the formation of a fire, when the aspirating is by a unit comprising a pipe system with aspirating holes;

continuous ionization of the aspirated ambient air;

continuous analysis of the measuring signals of the ion currents in a signal processing unit for the presence of significant changes;

triggering a fire alarm signal if significant changes are found for a predetermined period of time.

2. The method according to claim 1, wherein the significant change includes exceeding a maximum measuring value.

3. The method according to claim 1, wherein the significant change includes a predefined change in the rate of rise.

4. The method according to claim 1, wherein the significant change includes a combination of a predefined change in the rate of rise and a detection of a maximum value.

5. The method according to claim 1, wherein a fire alarm is triggered by significant changes of ion currents with different sets of parameters for field generation.

6. The method according to claim 1, wherein a fire alarm in which disturbance values are masked out is triggered by a comparison of the measuring values (ion currents) for at least one set of parameters for field generation with stored parameter sets of disturbance values.

7. The method according to claim 1, wherein alarm levels can be generated by significant changes of ion currents with one or different sets of parameters for field generation, and that a multiple-level alarm is thus triggered.

8. The method according to claim 1, wherein an alarm level leads to a shutdown of apparatuses and/or optical and/or acoustic notifications.

9. The method according to claim 1, wherein at least one signal of another sensor system for detecting another fire parameter is used for generating the fire alarm signal.

10. The method according to claim 9, wherein the signal of a gas sensor system for detection of low-molecular gases is used for generating the fire alarm signal.

11. A fire detector based on the detection of characteristic volatile thermolysis products which are specific to the material to be monitored, comprising:

an ion generation and ion current measuring chamber (10), in which the gas flow (5) of the aspirated ambient air is ionized, and which contains electrodes (16, 17), with a connector (19) for generating and regulating a D.C. voltage (21), a grounding, and a connector (18) for generating and regulating an alternating field (20) and at least two electrometer electrodes (22, 23) which detect characteristic ions;

an aspiration unit (1) through which the gas flow (5) is continuously supplied to the current measuring chamber;

wherein the aspiration unit (1) comprises a pipe system with aspirating holes; and a micro-controller system/signal processing unit (8) which continuously analyzes and stores the time dependence of the measured ion currents and which is designed to trigger one or more fire alarm levels if a significant change of the measured current for at least one set of parameters for field generation is detected for a predetermined period of time.

12. The device according to claim 11, wherein said micro-controller system/signal processing unit contains at least one stored set of parameters for field generation, in which a disturbance values is provided which is used for masking out this disturbance value for fire alarm generation.

13. The device according to claim 11, wherein the aspiration of the gas flow and thus the ion channeling through the measuring chamber occurs via a pump, a blower or a compressor in the gas outlet unit.

14. The device according to claim 11, wherein a display unit (27), an operating panel (key- and annunciator panel) or interface with the operating panel (28) and an interface (30) for parameterization of the device via a PC or a service unit are available on the device.

15. The device according to claim 11, wherein the aspiration unit (1) includes a sample gas tube (6) and a filtering unit (2), a pump (4) and a valve (3).

16. The device according to claim 13, wherein the pump (4) is a membrane pump.

17. The device according to claim 11, wherein the sample gas tube (6) is heatable.

18. The device according to claim 17, wherein the casing (12) of the ion generation and ion current measuring chamber (10) has a temperature sensor (13) for temperature regulation.

19. The device according to claim 11, further comprising interfaces (29) for transmitting status, malfunction and alarm messages to a fire alarm panel, and/or central fire alarm system, an alarm system and/or a building master control system are provided.

20. The device according to claim 11, further comprising a replaceable communication module for integration of the device into an addressable ring bus line/loop of fire detectors for transmission of status, malfunction and alarm messages via a protocol to a fire alarm panel.

* * * * *

UNITED STATES PATENT AND TRADEMARK OFFICE

CERTIFICATE OF CORRECTION

PATENT NO. : 9,035,243 B2
APPLICATION NO. : 13/158738
DATED : May 19, 2015
INVENTOR(S) : Kurt Lenkeit et al.

It is certified that error appears in the above-identified patent and that said Letters Patent is hereby corrected as shown below:

On the Title Page Item 75:

At column 1, line number 1, delete "Sulfeld" and insert --Sülfeld--, therefor.

In the Specification:

At column 1, line number 56, delete "$NO_X$," and insert --$NO_x$,--, therefor.

In the Claims:

At column 12, claim 19, line number 61, delete "(29)" and insert --(30)--, therefor.

Signed and Sealed this
Twenty-second Day of December, 2015

Michelle K. Lee

Michelle K. Lee
*Director of the United States Patent and Trademark Office*